US006753832B2

(12) United States Patent
Weitbruch et al.

(10) Patent No.: US 6,753,832 B2
(45) Date of Patent: Jun. 22, 2004

(54) METHOD FOR CONTROLLING LIGHT EMISSION OF A MATRIX DISPLAY IN A DISPLAY PERIOD AND APPARATUS FOR CARRYING OUT THE METHOD

(75) Inventors: Sebastien Weitbruch, Mönchweiler (DE); Carlos Correa, Villingen-Schwenningen (DE); Rainer Zwing, Villingen-Schwenningen (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 358 days.

(21) Appl. No.: 09/894,314

(22) Filed: Jun. 28, 2001

(65) Prior Publication Data

US 2002/0018032 A1 Feb. 14, 2002

(30) Foreign Application Priority Data

Jul. 13, 2000 (EP) ..... 00250231

(51) Int. Cl.[7] ..... G09G 3/28
(52) U.S. Cl. ..... 345/60; 345/68
(58) Field of Search ..... 345/60–63, 66–68; 315/169.1–169.4; 313/306, 309, 336, 351

(56) References Cited

U.S. PATENT DOCUMENTS

| | | | | | |
|---|---|---|---|---|---|
| 5,903,245 | A | * | 5/1999 | Shimizu et al. | 345/60 |
| 6,057,815 | A | * | 5/2000 | Sano | 345/60 |
| 6,340,960 | B1 | * | 1/2002 | Song et al. | 345/60 |
| 6,362,800 | B1 | * | 3/2002 | Moon | 345/60 |
| 6,492,776 | B2 | * | 12/2002 | Rutherford | 315/169.1 |
| 6,593,903 | B2 | * | 7/2003 | Nakamura et al. | 345/60 |

FOREIGN PATENT DOCUMENTS

DE 19850633 9/1999

* cited by examiner

*Primary Examiner*—Regina Liang
*Assistant Examiner*—Jennifer T. Nguyen
(74) *Attorney, Agent, or Firm*—Joseph S. Tripoli; Harvey D. Fried; Sammy S. Henig

(57) ABSTRACT

An improved addressing scheme for plasma display panel control comprises partitioning the panel into a number of sections and splitting the addressing period into correspondingly small addressing periods for each section. By varying the time distance between successive addressing periods of the sections from one sub-field to the other, at least for the sub-fields with higher weights, a better spread of the energy input and output of the plasma display panel is achieved and the power supply circuit for the display panel may be constructed with less expensive components.

5 Claims, 4 Drawing Sheets

METHOD FOR CONTROLLING LIGHT EMISSION OF A MATRIX DISPLAY IN A DISPLAY PERIOD AND APPARATUS FOR CARRYING OUT THE METHOD

BACKGROUND OF THE INVENTION

The invention relates to a method for controlling light emission of a matrix display in a display period and an apparatus for carrying out the method.

More specifically the invention is closely related to a new addressing concept for matrix displays in which different grey levels for pixels are generated by controlling light emission/reflection/transmission with small pulses in a pulse width modulation form. Such a concept is e.g. used in plasma display panels (PDP) or other display devices where the pixel values control the generation of a corresponding number of small lighting pulses on the display.

The Plasma technology now makes it possible to achieve flat colour panels of large size (out of the CRT limitations) and with very limited depth without any viewing angle constraints.

Referring to the last generation of European TV, a lot of work has been made to improve its picture quality. Consequently, a new technology like the Plasma one has to provide a picture quality as good or better than standard TV technology. This picture quality can be decomposed in different parameters:

- good response fidelity of the panel: A panel having a good response fidelity ensures that only one pixel could be ON in the middle of a black screen and in addition, this panel has to perform a good homogeneity. In order to improve that, a so-called "priming" is used which aims to excite the whole cells of the panel regularly but only during a short time. Nevertheless, since an excitation of a cell is characterized by an emission of light, the priming will modify the level of black. Therefore, this solution has to be used parsimoniously.
- good brightness of the screen: This is limited by the dead time of the panel, a time in which no light is produced, comprising mostly the addressing time, and the erase time.
- good contrast ratio even in a dark room: This is limited by the brightness of the panel combined with the black level $$\left(\text{ratio}\frac{\text{Brightness}}{\text{blacklevel}}\right).$$

In order to improve the response fidelity, the use of "priming" will, at the same time, reduce the contrast ratio.

All these parameters are also completely linked together and an optimal compromise has to be chosen to provide the best picture quality at the end.

Moreover, the success of such a new emerging technology is also dependent on its price. Furthermore, the power consumption of such a product should be as low as possible to ensure a consumer success.

A Plasma Display Panel (PDP) utilizes a matrix array of discharge cells which could only be "ON" or "OFF". Also unlike a CRT or LCD in which grey levels are expressed by analogue control of the light emission, a PDP controls the grey level by modulating the number of light pulses per frame (sustain pulses). This time-modulation will be integrated by the eye over a period corresponding to the eye time response.

Since the video amplitude determines the number of light pulses, occurring at a given frequency, more amplitude means more light pulses and thus more "ON" time. For this reason, this kind of modulation is also known as PWM, pulse width modulation. To establish a concept for this PWM, each frame will be decomposed in sub-periods called "sub-fields".

For producing the small light pulses, an electrical discharge will appear in a gas filled cell, called plasma and the produced UV radiation will excite a colored phosphor which emits the light.

In order to select which cell should be lighted, a first selective operation called addressing will create a charge in the cell to be lighted. Each plasma cell can be considered as a capacitor which keeps the charge for a long time. Afterwards, a general operation called "sustain" applied during the lighting period will add charges in the cell. In the cell addressed during the first selective operation, the two charges together will build up between two electrodes of the cell a firing voltage. UV radiation is generated which excites the phosphor for light emission. The discharge of the cell is made in a very short period and there remains some charge in the cell. With the next sustain pulse, this charge is increased again up to the firing voltage so that the next discharge will happen and the next light pulse will produced. During the whole sustain period of each specific sub-field, the cell will be lighted in small pulses. At the end, an erase operation will remove all the charges to prepare a new cycle.

The principle structure of a plasma cell in matrix plasma display technologie is shown in FIG. 1. Reference number 10 denotes the face plate made of glass. With reference number 11 a transparent line electrode is denoted. The back plate of the panel is referenced with reference number 12. There are two dielectric layers 13 for isolating face and back plate against each other. In the back plate are integrated column electrodes 14 being perpendicular to the line electrodes 11. The inner part of the cells consists of the luminous substance 15 (phosphor) and separators 16 for separating the different coloured phosphors (green 15*a*), (blue 15*b*), (red 15*c*). The UV radiation caused by the discharge is denoted with reference number 17. The light emitted from the green phosphor 15*a* is indicated with arrows having the reference number 18. From this structure of a PDP it is clear, that there are three plasma cells necessary, corresponding to the three colour components R,G,B, to produce the colour of a picture element of the displayed picture.

The gray level of each R,G,B component of a pixel is controlled in a PDP by modulating the number of light pulses per frame period. This time modulation will be integrated by the eye over a period corresponding to the human eye time—response.

This principle will now be explained. But those skilled in the art will known the principle from the literature. In video technology an 8 bit representation of each colour component R,G,B is common. In that case each level of the luminance for each colour component will be represented by a combination of the 8 following bits:

1 -2 -4 -8 -16 -32 -64 -128

To realize such a coding with the PDP technology, the frame period will be divided in 8 lighting periods (called sub-fields), each one corresponding to a bit. The number of light pulses for the bit "2" is the double as for the bit "1", and so forth. With these 8 sub-periods, it is possible, through sub-field combination, to build the 256 gray levels. The standard principle used to generate this gray modulation is based on the ADS (Address/Display Separated) principle, in which all operations are performed at different time on the whole panel. This principle is illustrated in FIG. 2.

FIG. 2 represents an example of ADS addressing scheme based on an 8-bit encoding with only one priming period at the beginning of the frame. This is only an example and there are very different sub-field organisations known from the literature with e.g. more sub-fields and different sub-field weights. Often, more sub-fields are used to reduce moving artifacts and priming could be used on more sub-fields to increase the response fidelity. Priming is a separate optional period, where the cells are charged. This charge can lead to a small discharge, i.e. can create background light, which is in principle unwanted. After the priming period an erase period follows for immediately quenching the charge. This is required for the following sub-field periods, where the cells need to be addressed again. So priming is a period which facilitates the following addressing periods, i.e. it improves the efficiency of the writing stage by regularly exciting all cells, simultaneously.

In the ADS addressing method all the basic cycles are made one after the other. At first, all cells of the panel will be written (addressed) in one period, afterwards all cells will be lighted (sustained) and at the end all cells will be erased together. In all these cases, since operations are made on the whole panel, the time required for the operation, is long. In other words, if we take the example of priming and writing, the time between the last cell to be written and the priming of the whole panel has the duration of the writing of all previous cells. In that case, the efficiency of the priming operation is reduced, because the time distance between priming a cell and sustaining a cell is long. In this time period the cell can recover from the priming operation and the bonus effect of priming is subjectively smaller. In consequence, more energy to write the cells is needed. The same thing happens in case of sustaining with a long time between writing and sustaining. Even in that case, we need more energy to write the cell to be sure that the sustain will work afterwards (the stored charges diminish with the time). In addition, there is a strong flow of energy during the sustain time and not during any other operation. This means that energy is concentrated and not spread during the whole frame. This introduces more stress in the power supply which requires higher quality of components at higher prices (bigger capacitors, etc.).

In FIG. 2 the sub-fields SF1 to SF8 vary in lengths. Each sub-field consists of addressing period, sustain period and erase period. The addressing period length is equal for all sub-fields, also the erase period length. In the addressing period, the cells are addressed linewise from line 1 to line N of the display. In the erasing period all the cells will be discharged in parallel in one shot, which does not take as much time as for addressing. The example in FIG. 2, shows that all operations addressing, sustaining and erasing are completely separated in time. At one point in time there is one of these operations active for the whole panel. And this reduces the efficiency of these operations. There is a long time between operations which should interact. In addition, there is a strong concentration of energy during the sustain periods which will stress the power supply of the PDP. These drawbacks are explained in greater detail with the illustration shown in FIG. 3.

In FIG. 3, Tad stands for the addressing time for the complete panel. Ter stands for the erasing time of the complete panel. And these are the long time distances which cause a problem. During these times, the charge of a written cell can diminish and the cell characteristics may change in general, e.g. resitance, capacity, etc. as explained above. To improve the situatuion, one first idea could be to simply reduce the addressing time by a faster addressing but this would have a negative impact on the response fidelity of the panel. In like manner, a reduction of the erase time can generate false erasure which appears as flashing pixels in dark areas.

A first approach of solving these problems, is described in U.S. Pat. No. 5,903,245. In this document it is proposed to subdivide a plasma display panel in several partitions, called scan blocks. The solution is described at the example of a panel made in coplanar plasma display technology. The addressing of the panel is made different to the above described ADS addressing scheme. The addressing (writing) is done separately for the different scan blocks, and no longer for the whole panel. This allows for a reduction of the time difference between addressing and sustaining periods even in the simplest embodiment, where a common sustain period is following after the last scan block has been addressed. In an advanced embodiment described in this document (see FIG. 23), there follows after a completed addressing period for one scan block, immediately, a relatively short sustain phase for this scan block. During this phase, in the remaining scan blocks a priming and erase period or a sustain period is likewise performed. Thus, in this embodiment a spreading of the sustaining period is achieved and the energy output is stretched in the sub-field periods. However, there follows in each case a constant sustain period after the addressing period as can be seen in FIG. 27 and the corresponding description.

SUMMARY OF THE INVENTION

It is an object of the invention to further improve the addressing scheme of plasma display panels, so that the energy output is better spread over the frame period. This object is solved by a method according to claim 1.

It is a further object of the invention to disclose an apparatus which is capable of performing the inventive method. Such an advantageous apparatus is defined in claim 4.

The addressing scheme according to the invention, called ADM (address display multiplexing) individualizes all the basic operations addressing, sustaining and erasing to a part of the panel (called sub-panel), for instance per driver, to reduce time between each operation performed on a given sub-panel. Instead of writing the whole panel, only a sub-panel will be written and afterwards this sub-panel will be lighted. This is common to the solution described in U.S. Pat. No. 5,903,245.

The further improvement to the disclosure of this document consists in the measure that the time distance between the successive addressing periods for the respective sub-panels is set to be constant within a given sub-field but varies from one sub-field to the other. The variation of the time distance between sub-field addressing periods in different sub-fields improves the efficiency of each basic operation to achieve a low-voltage addressing as well as a better response fidelity and a better panel homogeneity. In addition the improvement in terms of addressing efficiency, panel homogeneity will permit to increase the speed of some operation (addressing, sustaining) to win more time, which can be used for generating more light. Moreover, the use of low-power addressing will further reduce the price of the electronics. In addition, the energy will be spread during the whole frame and the peak current will be reduced, as well as the stress on all the power components. For these reasons, it will be possible to reduce the cost as well as the power supply complexity, in terms of component count.

For ease of implemetation of the new addressing scheme in an apparatus, it is advantageous to make the partition of the panel in sub-panels in correspondence to the amount and size of the plasma display panel scan drivers as claimed in claim 4.

Further advantageous embodiments are apparent from the dependent claims.

BRIEF DESCRIPTION OF THE DRAWINGS

Exemplary embodiments of the invention are illustrated in the drawings and are explained in more detail in the following description.

DESCRIPTION OF THE PREFFERED EMBODIMENTS

Figure 1:
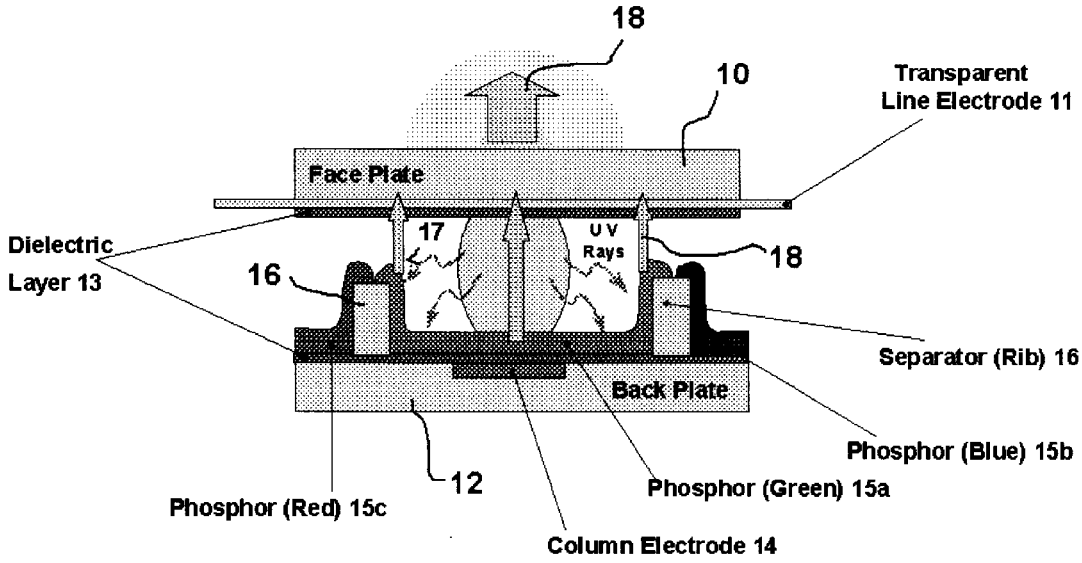
FIG. 1 shows the cell structure of a plasma display panel in matrix technoloy.
Figure 2:
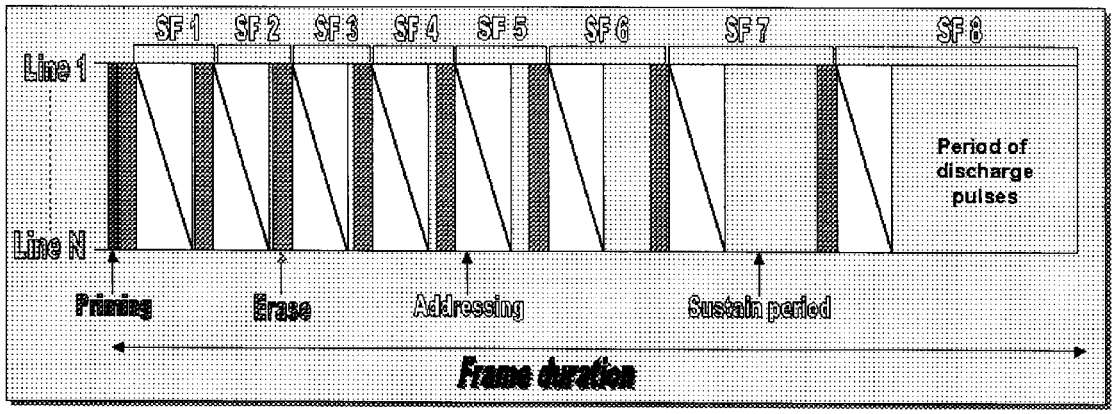
FIG. 2 shows the conventional ADS addressing scheme during a frame period.
Figure 3:
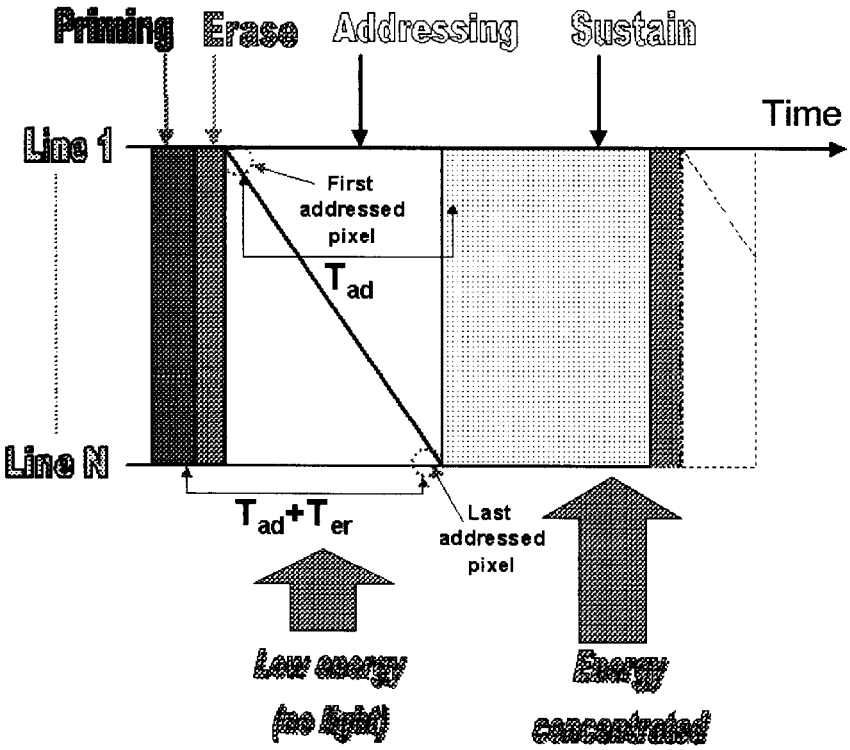
FIG. 3 shows an illustration for explaining the drawback of the conventional ADS addressing scheme.

The general concept of light generation in plasma display panels is shown in FIG. 2. As mentioned before, a plasma cell can only be switched on or off. Therefore, the light generation is being done in small pulses where a plasma cell is switched on. The different colours are produced by modulating the number of small pulses per frame period. To do this a frame period is subdivided in so called sub-fields SF. Each sub-field SF has assigned a specific weight which determines how many light pulses are produced in this sub-field SF. Light generation is controlled by sub-field code words. A sub-field code word is a binary number which controls sub-field activation and inactivation. Each bit being set to 1 activates the corresponding sub-field SF. Each bit being set to 0 inactivates the corresponding sub-field SF. In an activated sub-field SF the assigned number of light pulses will be generated. In an inactivated sub-field there will be no light generation.

For clarification, a definition of the term sub-field is given here: A sub-field is a period of time in which successively the following is being done with a cell:

1. There is a writing/addressing period in which the cell is either brought to an excited state with a high voltage or with lower voltage to a neutral state.
2. There is a sustain period in which a gas discharge is made with short voltage pulses which lead to corresponding short lighting pulses. Of course only the cells previously excited will produce lighting pulses. There will not be a gas discharge in the cells in neutral state.
3. There is an erasing period in which the charge of the cells is quenched.

Figure 5:
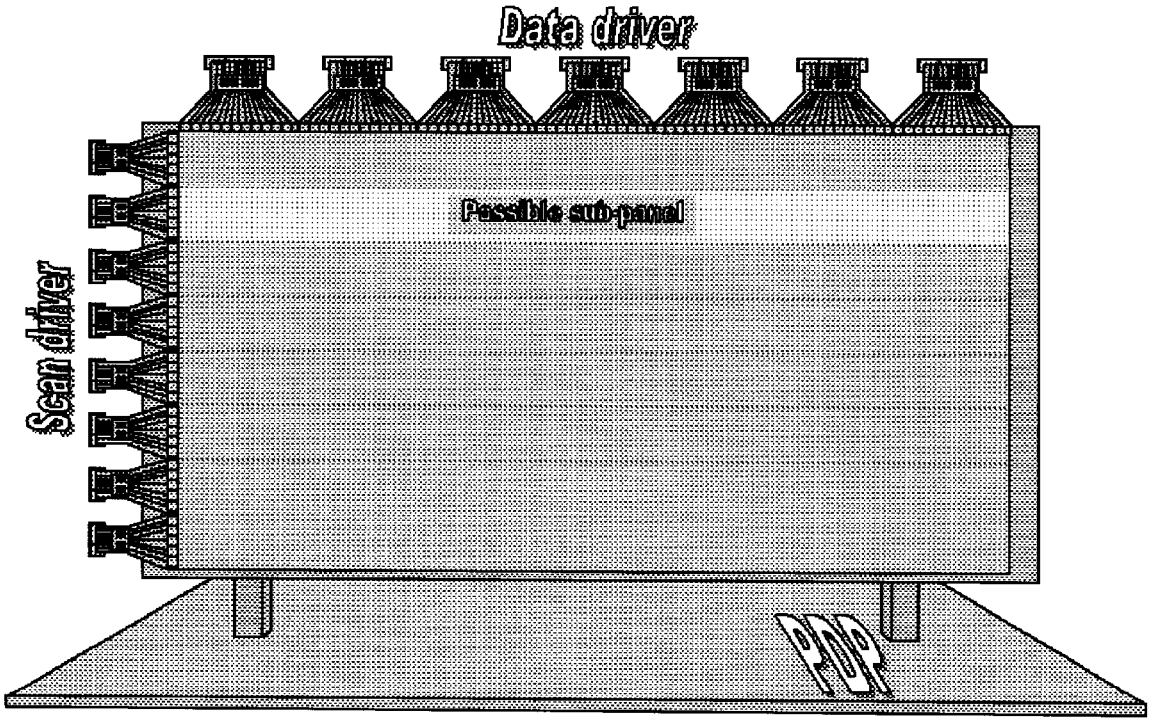
FIG. 5 shows an example of a line-driver wise partition of the plasma panel.
Figure 4:
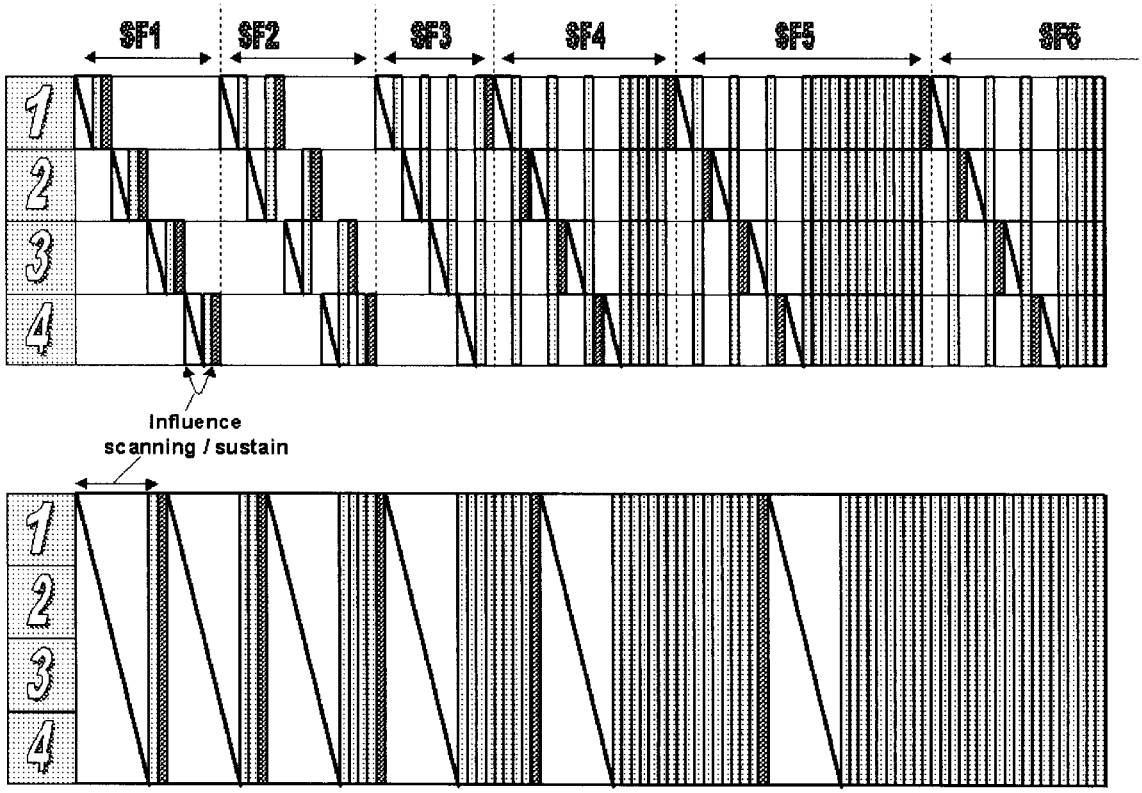
FIG. 4 shows a first embodiment of the ADM addressing scheme for the plasma matrix technology.

In FIG. 4, the principle of the ADM addressing scheme is shown compared to the ADS addressing scheme. The plasma panel is partitioned in 4 sub-panels corresponding to the numbers 1 to 4. The partition is made in horizontal direction. Assuming that the display has 480 lines, the first sub-panel comprises the first 120 lines of the display, the second sub-panel comprises lines 121 to 240, the third sub-panel lines 241 to 360 and the fourth sub-panel comprises lines 361 to 480. Of course, this is only an example and there can be a different type of partitition used. One very good possibility is to make a driver-wise partition, which means that each sub-panel will correspond to a scanning driver. This will enable to work with really optimized scanning drivers (low-voltage driver for addressing . . . at lower cost) which will reduce the global power consumption of the panel. An example of a driver-wise partition is shown in FIG. 5. Here, it is shown that the PDP has 8 scan drivers for the horizontal addressing lines. This means that in case of 480 lines on the display to each driver 60 lines are assigned. The partition of the panel in sub-panels is correspondingly made, i.e. each sub-panel consists of 60 lines of the panel which can be driven with one scan driver. Apart from the scan drivers also the data drivers are shown in FIG. 5. There are 7 data drivers for the columns of the panel. In case there are 854 pixels in one line, this means, that to each data driver 122*3 data lines are assigned to each data driver. Note, that each pixel consists of 3 consecutive cells for the three colour components R,G,B.

The conventional ADS addressing scheme is depicted in the lower part of FIG. 4. For producing 256 different video levels, which is common in video technology, the subfield organisation shown in FIG. 2 can be used, where the sub-field weights are 1 -2 -4 -8-16 -32 -64 -128. This is the simplest sub-field organisation and it is pointed out that often some other types of sub-field organisations are used, e.g. with 12 sub-fields where the sub-field weights have a refined gradation. In FIG. 4 only the first 6 of the 8 sub-fields are depicted for simplification. All sub-panels are summarized so that the whole panel can be regarded as one part. Each sub-field comprises addressing, sustaining and erasing period. During the addressing period the whole panel will be addressed linewise, i.e. addressing is performed for lines 1 to line 480 continuously. As mentioned above, this takes a relatively long time. Afterwards, to the cells of the whole panel the sustaining pulses are fed simultaneously. As the sub-fields of a frame period have different weights, different amounts of sustain pulses are produced for the different sub-fields. The amount of sustain pulses increases from the left to the right of the picture. After the sustain period an erase period follows, where all plasma cells of the panel are discharged with a corresponding voltage pulse of different polarity.

In the example shown in FIG. 4 it is assumed that no priming period ahead of the first sub-field is present. But this is not mandatory and in another embodiment, one or more priming periods can be part of the sub-field organisation.

The upper part of FIG. 4 shows the addressing scheme related to the first five sub-fields. The sixth sub-field is only partly displayed. A weight unity will correspond to a packet of sustain pulses. The basic concept of this scheme is that, for each sub-field, first, the sub-panel 1 will be addressed, then a group of sustain pulses corresponding to one weight unity will be produced for sub-panel 1, then in the same sub-field, the cells of the second sub-panel 2 will be addressed and the number of sustain pulses for the first weight unity will be produced on this sub-panel, and so on. This weight unity will happen at the same time on sub-panel N+1 as the second weight unity of the same sub-field on sub-panel N and so forth.

In the first sub-field SF1, the sustain period has only a weight of 1. Therefore, it directly follows the erase period for the respective sub-panel. In the second sub-field SF2, the sustain period has a weight of 2. Therefore, the erase period for the first sub-panel follows after the second shot of sustain periods. The second shot of sustain periods happen in the same time as the first shot for the second sub-panel. In the fourth sub-field SF4 with weight 8, there is a period where the remaining sustain pulses for the weight unities 5 to 8 are produced summarized one after the other on all sub-panels in common. This structure is true also for the sub-fields SF5 to SF8. For all sub-fields there is a small time distance between the addressing periods corresponding to one weight unity except for the first sub-field, where the distance is slightly longer because of the erase period.

The most important difference to the ADS addressing scheme is, that the addressing time, for each sub-panel, has been reduced since the number of lines to be addressed per sub-panel has been reduced. This increases a lot the response fidelity and the homogeneity of the panel, reducing the need of priming (better contrast) and enabling a faster addressing in terms of addressing speed. The global gain in time obtained with a higher addressing speed will enable to make more light.

In FIG. 4 the faster addressing speed is not shown. FIG. 4 focusses merely on the comparison between ADM and ADS in terms of time delay between scanning and sustaining and the repartition of energy. In addition, the use of only 4 sub-panels is not optimized. Nevertheless, it is obvious that there will be less delay between operations in case of ADM and the energy will be better spread over the frame period. This will introduce a gain in terms of response fidelity, as well as in terms of power consumption and power supply optimization.

Furthermore, the gain obtained in terms of response fidelity will enable a faster addressing, sparing time that can be used to produce more light (sustain pulses) for contrast improvement.

Figure 6:
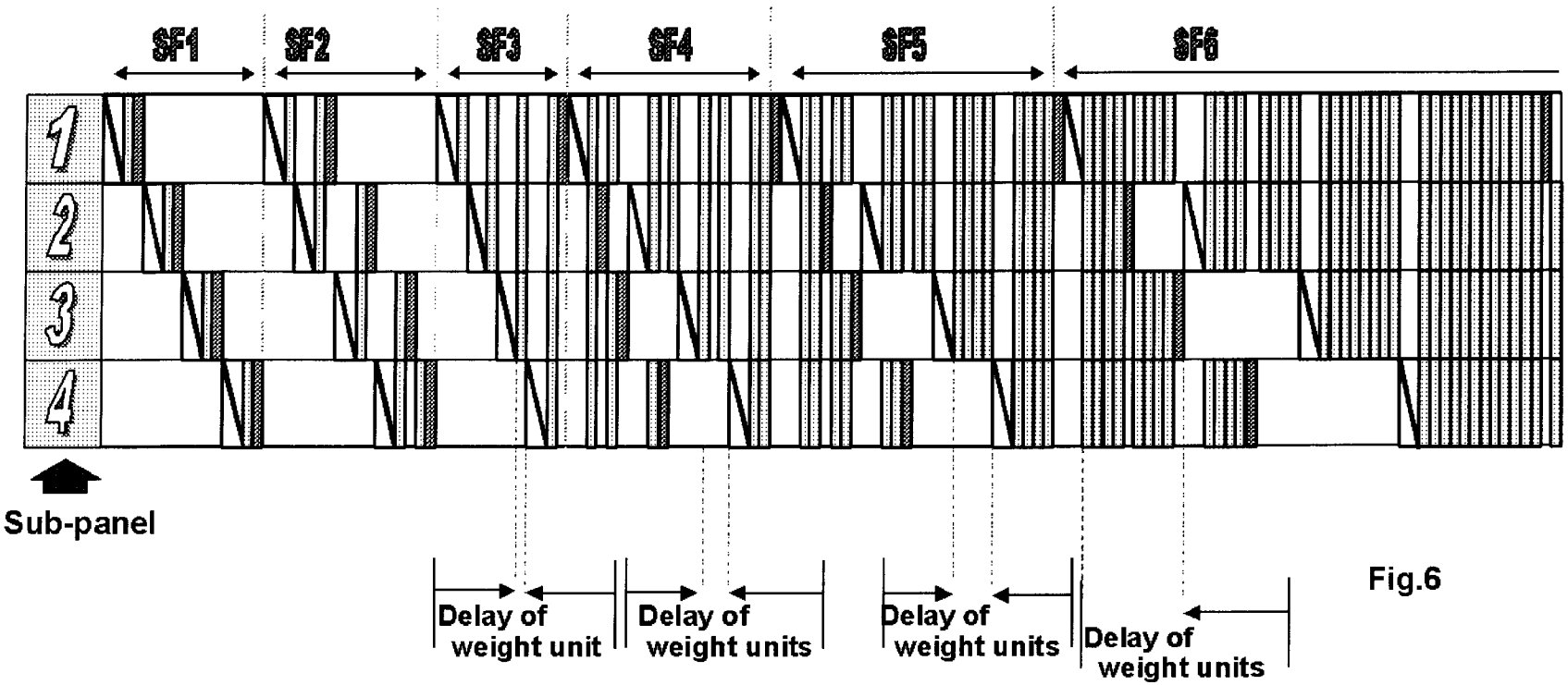
FIG. 6 shows an improved embodiment of the ADM addressing scheme according to the invention.

In FIG. 6 an improved embodiment of the ADM addressing scheme is shown. In this embodiment the time distance between addressing periods varies. It is not always one weight unity for all sub-fields as in the example of FIG. 4. The time distance of one weight unity is valid only for the first three sub-fields SF1 to SF3. For the fourth sub-field the time distance is two weight unities, for the fifth sub-field SF5 four weight unities, for the sixth sub-field SF6 eight weight unities, for the seventh sub-field SF7 sixteen weight unities and for the eights sub-field SF8 thirtytwo weight unities. Of course, within one sub-field the time distance between successive addressing periods remains constant. This scheme follows the rule that for each sub-field, the time distance is 25% of the assigned sub-field weight. For the first two sub-fields the resulting value is a fraction of 1 and these values are rounded up because the smallest sustain period which can be set is that with one weight unity.

FIG. 6 shows that, in case of the second ADM scheme, the energy input and output will be better spread over the frame period, especially for the sub-fields with higher weights. This allows for a better optimization of the power supply in terms of component count and component costs.

The above picture describes a possible implementation. The control block selects the appropriate sub-panel that should be primed/addressed/erased. When a given sub-panel is selected, the required frame memory address is evaluated, in order to allow a direct memory access to the corresponding video contents. At the same time the control block generates all prime, erase, scan and sustain pulses in the order required by either of the proposed ADM sequences.

Figure 7:
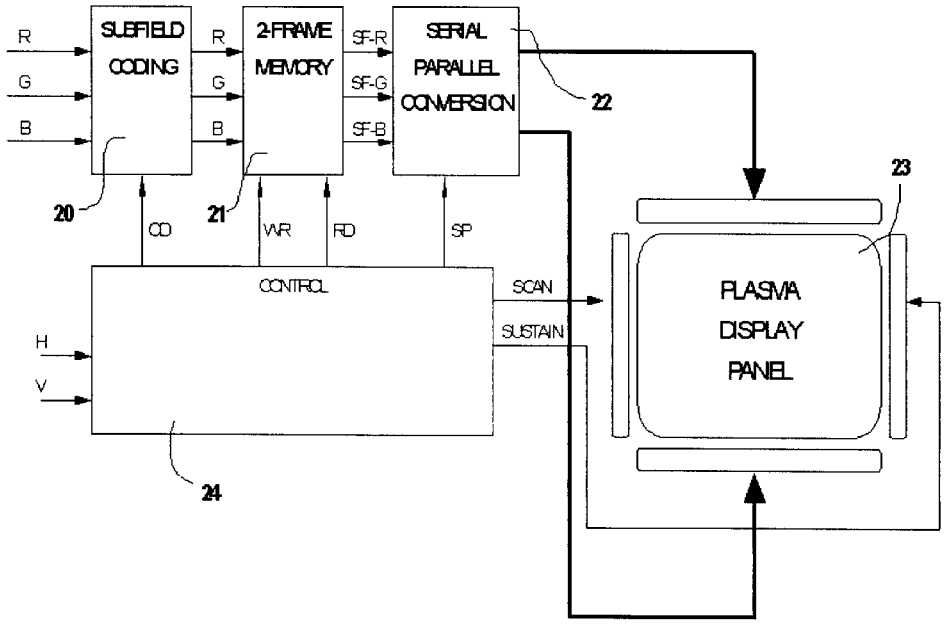
FIG. 7 shows a block diagram of a circuit implementation of the invention in a PDP.

In FIG. 7 a circuit implementation of the invention is illustrated. Input R,G,B video data is forwarded to a sub-field coding unit 20. The sub-field code words are forwarded to a memory 21 separately for the different colour components R,G,B. This memory preferably has a capacity of two frame memories. This is recommendable due to the plasma driving process. The plasma display panel is driven in sub-fields as explained above and therefore for every pixel only one bit (in fact three bits because of the three colour components) needs to be read out of this memory per sub-field. On the other hand data needs to be written in the memory. To avoid any conflicts between writing and reading, there are two independent frame memories used. When data is read from one frame memory, the other frame memory is used for writing of data and vice versa.

The read bits of the sub-field code words are collected in a serial parallel conversion unit 22 for a whole line of the PDP. As there are e.g. 854 pixel in one line, this means 2962 sub-field coding bits needs to be read for each line per sub-field period. These bits are input in the shift registers of the serial parallel conversion unit 22.

The sub-field code words are stored in memory unit 21. Reading and writing from and to this memory unit is also controlled by the external control unit 24. The control unit 24 controls writing and reading from and to the memory 21. Also it controls the sub-field coding process and the serial parallel conversion. Further it generates all scan, sustain and erase pulses for PDP control. It receives horizontal and vertical synchronising signals for reference timing.

The invention can be used in particular in PDPs. Plasma displays are currently used in consumer electronics, e.g. for TV sets, and also as a monitor for computers. However, use of the invention is also appropriate for matrix displays where the light emission is also controlled with small pulse in sub-fields, i.e. where the PWM principle is used for controlling light emission.

What is claimed:

1. A method for controlling light output of a matrix display in a frame period, the matrix display consisting of a plurality of cells, the light generation of the cells being done in small pulses, the frame period being subdivided into a number of sub-fields having at least partly different weights, each of the sub-fields consisting of at least an addressing, sustaining and erasing period, wherein the display panel is subdivided in at least two sections, the cells of one section being addressed in a dedicated corresponding address period, wherein, to each section is assigned a separate addressing period within a sub-field, and an address operation in one section may not overlap in time with a sustain operation in another section, wherein the time distance between the at least two successive addressing periods of the at least two sections is constant within one sub-field, but varies from one sub-field to the other, in particular for the sub-fields with higher weights and wherein the time distance increases in the direction from lower sub-field weight to higher sub-field weight.

2. The method according to claim 1, wherein the time distance between the successive addressing periods of the sections within one sub-field is a predetermined percentage value of the sub-field weighting.

3. The method according to claim 2, wherein the predetermined percentage value is 25%.

4. Apparatus for carrying out the method according to claim 1, further comprising, control means for controlling the light output of the matrix display in a frame period, the control means being designed to perform light generation of the cells in small pulses, a driving means for performing addressing, sustaining and erasing in each of the sub-fields, the driving means being designed to perform addressing of the cells of one section in a dedicated corresponding address period, wherein, to each section a separate addressing period within a sub-field is assigned, and an address operation in one section may not overlap in time with a sustain operation in another section, wherein the control means are further designed to vary the time distance between the at least two successive addressing periods of the at least two sections from one sub-field to the other, in particular for the sub-fields with higher weights while keeping the time distance constant within one sub-field, and wherein the control means are further designed to increase the time distance between the at least two successive addressing periods of the at least two sections in the direction from lower sub-field weight to higher sub-field weight.

5. The apparatus according to claim 4, wherein a plurality of line and column drivers is provided for addressing the matrix display cells, and the partition of the matrix display in sections is made in horizontal direction, namely line driver-wise, wherein all the matrix cells which are addressed with one line driver belong to one display section.

* * * * *